US010322439B2

(12) United States Patent
Mastroianni

(10) Patent No.: US 10,322,439 B2
(45) Date of Patent: Jun. 18, 2019

(54) DUAL NOZZLE JETTING TOOL FOR TANK CLEANING AND RELATED METHODS

(71) Applicant: IDRABEL ITALIA S.R.L., Savona (IT)

(72) Inventor: Maurizio Mastroianni, Savona (IT)

(73) Assignee: IDRABEL ITALIA S.R.L., Savona (IT)

( * ) Notice: Subject to any disclaimer, the term of this patent is extended or adjusted under 35 U.S.C. 154(b) by 535 days.

(21) Appl. No.: 14/411,509

(22) PCT Filed: Jun. 28, 2013

(86) PCT No.: PCT/EP2013/063737
§ 371 (c)(1),
(2) Date: Dec. 28, 2014

(87) PCT Pub. No.: WO2014/001551
PCT Pub. Date: Jan. 3, 2014

(65) Prior Publication Data

US 2015/0158061 A1 Jun. 11, 2015

(30) Foreign Application Priority Data

Jun. 29, 2012 (IT) ..... MI2012A1150

(51) Int. Cl.
*B08B 9/093* (2006.01)

(52) U.S. Cl.
CPC ..... *B08B 9/093* (2013.01); *B08B 9/0936* (2013.01)

(58) Field of Classification Search
CPC ..... B08B 9/093; B08B 9/0936
See application file for complete search history.

(56) References Cited

U.S. PATENT DOCUMENTS

| | | | | |
|---|---|---|---|---|
| 3,595,256 | A | 7/1971 | Waltman et al. | |
| 3,856,570 | A * | 12/1974 | McDermott | B08B 9/093 134/167 R |
| 4,986,476 | A | 1/1991 | Hour | |
| 2013/0008979 | A1* | 1/2013 | Lange | B05B 3/0427 239/380 |

FOREIGN PATENT DOCUMENTS

| | | | |
|---|---|---|---|
| DE | 4301388 | A1 | 8/1993 |
| DE | 102005038194 | B3 | 7/2006 |
| DE | 102009059252 | A1 | 6/2011 |
| WO | 2011019492 | A1 | 2/2011 |

OTHER PUBLICATIONS

Flex-Hose Co., Annular Corrugated Metal Hose Assemblies, Feb. 1, 2001, Flex-Hose Co., date stamp, paragraph on Annular Corrugated Metal Hose Assemblies, figure titled Movement Capabilities.*

International Search Report and Written Opinion for corresponding PCT Application Serial No. PCT/EP2013/063737 dated Oct. 16, 2013, 14 pages.

* cited by examiner

*Primary Examiner* — Jason Y Ko
(74) *Attorney, Agent, or Firm* — David J. Smith

(57) ABSTRACT

System, tool and method for cleaning a tank that stores oil products. A jetting tool has a first nozzle (114) and a second nozzle (116). The jetting tool may be movably disposed within the tank, such as vertically and/or horizontally and is configured to receive fluid from a flowline (105) to expel the fluid through at least one of the first nozzle and the second nozzle of the jetting tool.

20 Claims, 9 Drawing Sheets

DUAL NOZZLE JETTING TOOL FOR TANK CLEANING AND RELATED METHODS

BACKGROUND

Embodiments disclosed herein relate generally to fluid storage tanks. In particular, embodiments disclosed herein relate to apparatus and methods for cleaning fluid storage tanks.

Fluid storage tanks are used the world over in refineries, terminals, and tank farms for storing oil products. The storage tanks are subjected to periodical cleaning operations due to sludge accumulation, inspection, and maintenance. Sludge accumulation occurs due to the slow sedimentation of high gravity petroleum products near or at the bottom of the fluid storage tanks, and may lead to various problems, including loss of operational capacity of the storage tanks, loss of working time, and/or acceleration of corrosion occurring within the storage tanks. Further, traditional cleaning systems often involve the manual removal of the accumulated sludge, which may also lead to various problems, including increased health and safety risks to the cleaning personnel, high volumes of sludge waste that may be disposed of, and prolonged shutdown times of the storage tanks.

Accordingly, an apparatus and method that may minimize the undesired effects from the traditional cleaning systems, such as by minimizing the volume of the final waste to be disposed of and/or minimizing the exposure of personnel to the interior of the storage tanks is described.

DETAILED DESCRIPTION

The following is directed to various embodiments of the disclosure. Although one or more of these embodiments may be preferred, the embodiments disclosed should not be interpreted, or otherwise used, as limiting the scope of the disclosure, including the claims. In addition, those having ordinary skill in the art will appreciate that the following description has broad application, and the discussion of any embodiment is not intended to suggest that the scope of the disclosure, including the claims, is limited to that embodiment.

Certain terms are used throughout the following description and claims refer to particular features or components. As those having ordinary skill in the art will appreciate, different persons may refer to the same feature or component by different names. This document does not intend to distinguish between components or features that differ in name but not function. The figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first component is coupled to a second component, that connection may be through a direct connection, or through an indirect connection via other components, devices, and connections. Further, the terms "axial" and "axially" generally mean along or parallel to a central or longitudinal axis, while the terms "radial" and "radially" generally mean perpendicular to a central longitudinal axis. Additionally, directional terms, such as "above," "below," "upper," "lower," "horizontal," "vertical," etc., are used for convenience in referring to the accompanying drawings, and the terms are not meant to limit the disclosure.

In one aspect, embodiments disclosed herein relate to a jetting tool that may be disposed within and used to clean a storage tank that stores oil products. Prior to inserting the jetting tool, a sludge mapping and characterization process may be performed, which may include thermographic, density, and/or viscosity profiles that are taken to determine the quantity of sludge in the storage tank. In addition, characterization processes may be performed, including sampling, density and viscosity profiles, and analysis of the sludge to allow for an optimal tank cleaning strategy to be developed.

Figure 1A:
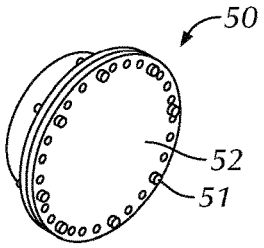
FIG. 1A shows a perspective view of a manway of a storage tank in accordance with one or more embodiments of the present disclosure.
Figure 1B:
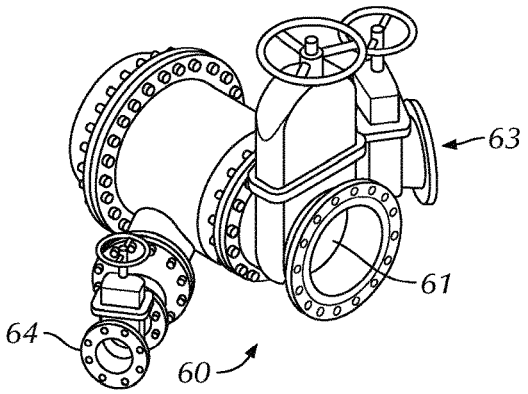
FIG. 1B shows a perspective view of a manhole adaptor in accordance with one or more embodiments of the present disclosure.

Referring initially to FIGS. 1A and 1B, perspective views of a storage tank manway 50 (i.e., an opening through which access to the internal volume of a storage tank 40 is provided) and a manhole adaptor 60 in accordance with one or more embodiments of the present disclosure are shown. After mapping and characterization processes have been performed, and a strategy has been determined for cleaning the storage tank, a process known as "cold tapping" may be performed. This process involves preparation prior to having a jetting tool be inserted and disposed within the storage tank 40. As shown, the manway 50 has a cover 52 (e.g., a plate) secured to the storage tank with multiple fasteners (e.g., bolts). Without opening the tank, several bolts may be removed from the manway 50, while still leaving multiple bolts 51 in place to secure the cover 52 to the manway 50. Those skilled in the art will appreciate that while eight bolts remain in this example, any number of bolts may remain in other examples.

Next, the manhole adaptor 60 having a central bore 61, and a gasket (not shown) to engage the manway 50, is placed over the manway 50 and secured thereto by way of larger holes in the manhole adaptor flange that fit over the remaining manway cover bolts 51. The manhole adaptor 60 includes a front valve 62 and two side valves 63 and 64 installed thereon. In this embodiment, the front valve 62 may be about 16 inches (40.6 cm), the side valve 63 may be about 10 inches (25.4 cm), and the side valve 64 may be about 6 inches (15.2 cm). However, those having ordinary skill in the art will appreciate that the size and configuration of the manhole adaptor may vary, such as to include more or less valves as desired, or valves of different sizes, without departing from the scope of the present disclosure. After installation of the manhole adaptor 60, the valves 62, 63, and 64 may be closed and the manhole adaptor 60 may be pressure tested.

Figure 2A:
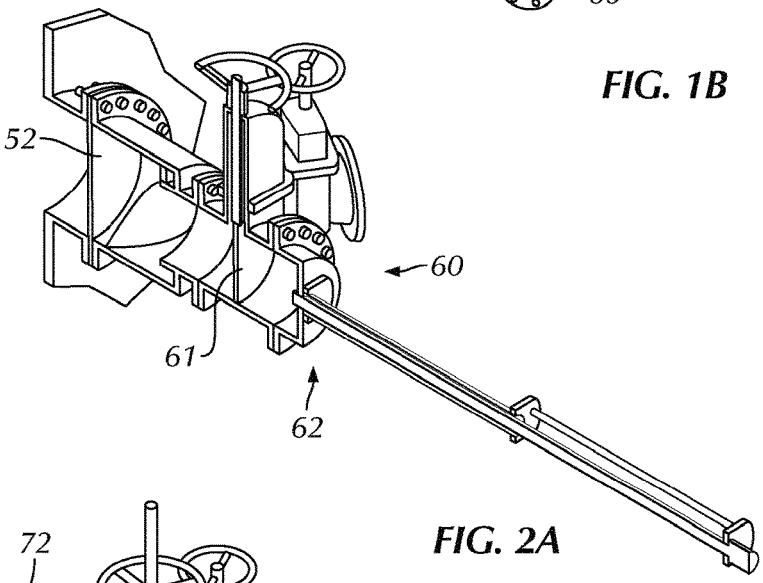
FIG. 2A shows a cutaway view of a cutting tool in accordance with one or more embodiments of the present disclosure.
Figure 2B:
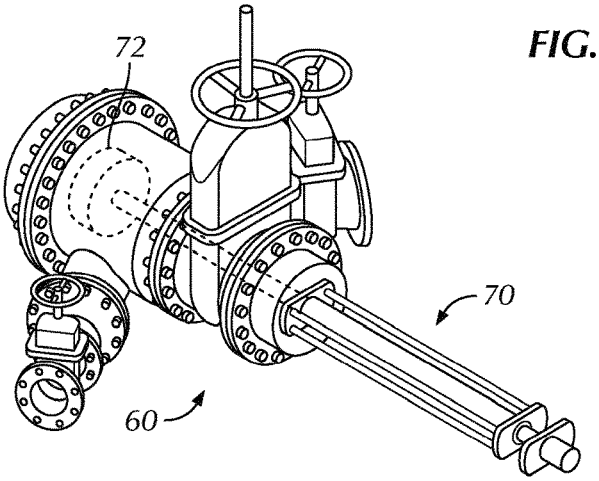
FIG. 2B shows a perspective view of a cutting tool in accordance with one or more embodiments of the present disclosure.

Referring now to FIGS. 2A and 2B, multiple views of a cold-tapping device 70 in accordance with one or more embodiments of the present disclosure are shown. FIG. 2A provides a cutaway view of the cold-tapping device 70 before use, and FIG. 2B provides a perspective view of the cold-tapping device 70 while used to cut into the manway cover 52. Following installation of the manhole adaptor 60, the cold-tapping device 70 may be secured to the manhole adaptor 60, such as by bolting the cold-tapping device to the adaptor 60. The cold-tapping device 70 may include a cutting head 72 that may move axially within and through the central bore 61 of the manhole adaptor 60. As such, the front valve 62 of the manhole adaptor 60 may be open after the cold-tapping device 70 is installed, and the cutting head 72 may enter into and through the central bore 61 of the manhole adaptor 60. The cutting head 72 may then cut into and through the manway cover 52, thereby providing access inside the storage tank 40.

Figure 3A:
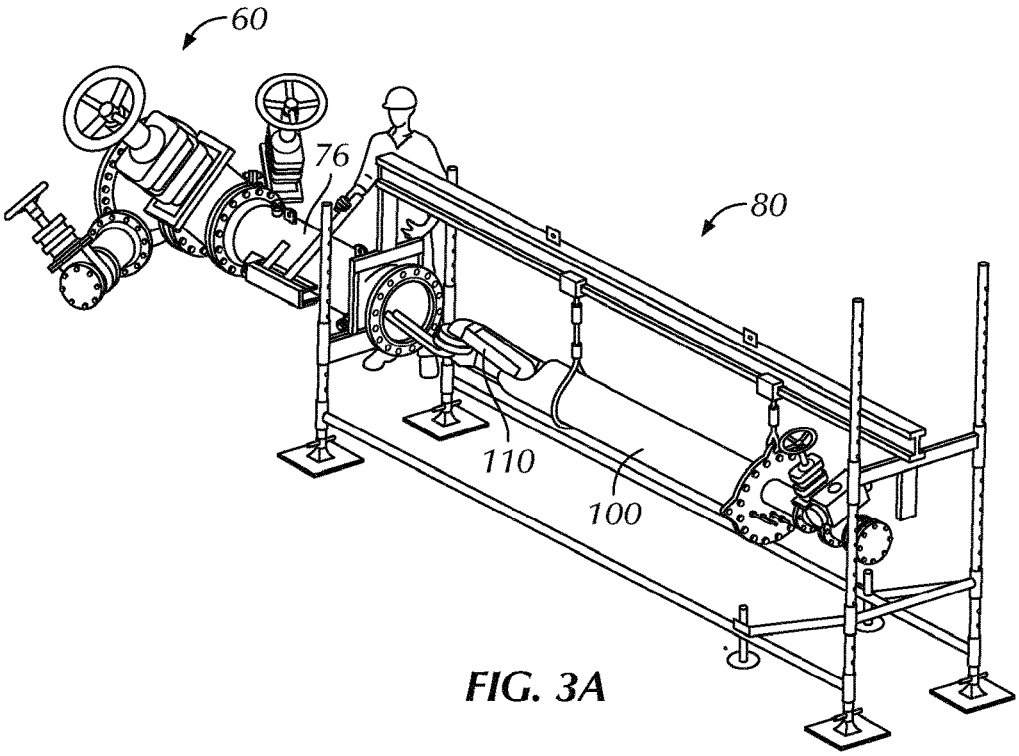
FIG. 3A shows a perspective view of a jetting tool system secured within an alignment system in accordance with one or more embodiments of the present disclosure.
Figure 3B:
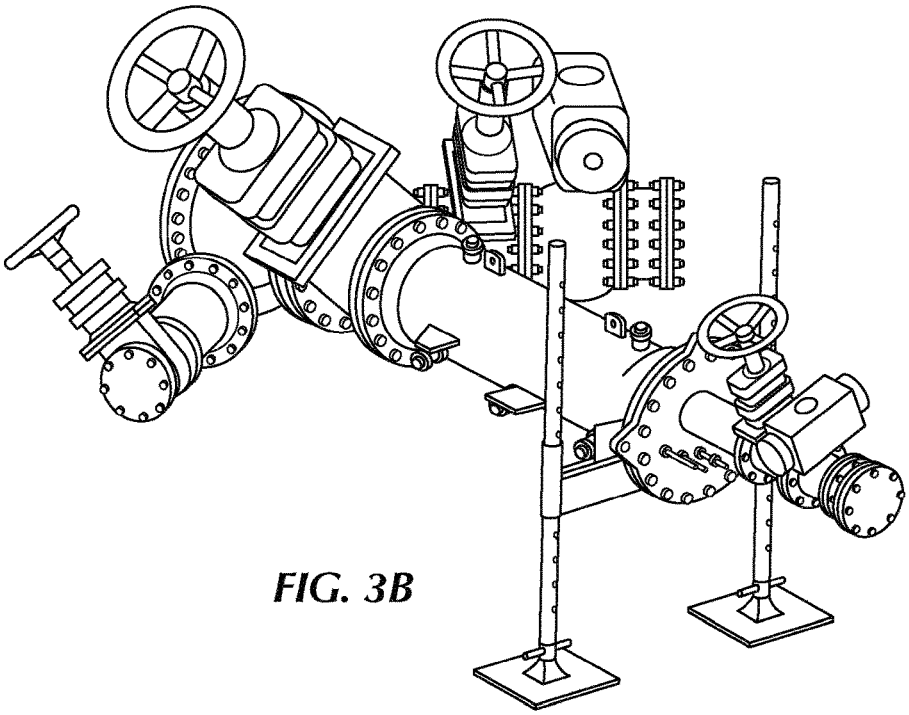
FIG. 3B shows a perspective view of a jetting tool system inserted within a manhole adaptor in accordance with one or more embodiments of the present disclosure.
Figure 3C:
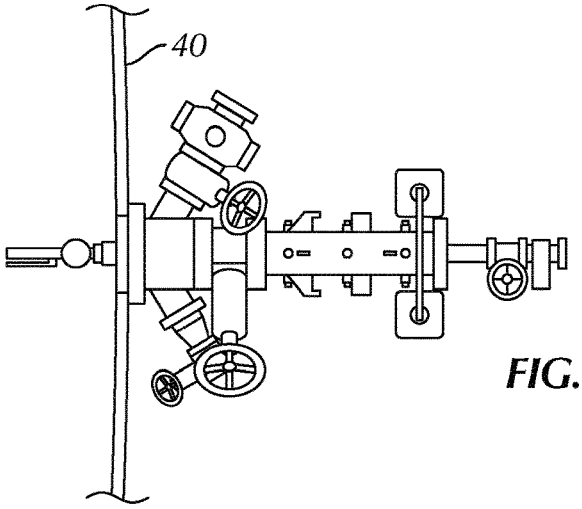
FIG. 3C shows an above perspective view of a jetting tool system inserted within a manhole adaptor in accordance with one or more embodiments of the present disclosure.

Referring now to FIGS. 3A, 3B, and 3C, multiple views of a jetting tool system 100 and an alignment system 80 in accordance with one or more embodiments of the present disclosure are shown. FIG. 3A provides a perspective view of the jetting tool system 100 secured within the alignment system 80 before installation and insertion within the manhole adaptor 60, and FIGS. 3B and 3C provide perspective views of the jetting tool system 100 after being inserted within and secured to the manhole adaptor 60.

After the cold-tapping device 70 cuts through the manway cover 52, the cold-tapping device 70 may be removed such that an additional cylinder 76 having a central bore extending therethrough may be attached to the manhole adaptor 60. In addition, as shown in FIG. 3A, the jetting tool system 100 may be suspended within the alignment system 80 to be aligned with the cylinder 76. After alignment, the jetting tool system 100, discussed more below and having a jetting tool 110 coupled to an end thereof, may be inserted within the cylinder 76 such that the jetting tool 110 of the jetting tool system 100 is disposed within the storage tank 40 for the sludge removal operation, as shown in FIGS. 3B and 3C. Further, one or more automated shut-off valves 78 may also be incorporated to control fluid flow through the manhole adaptor 60 and/or the jetting tool system 100.

Figure 4:
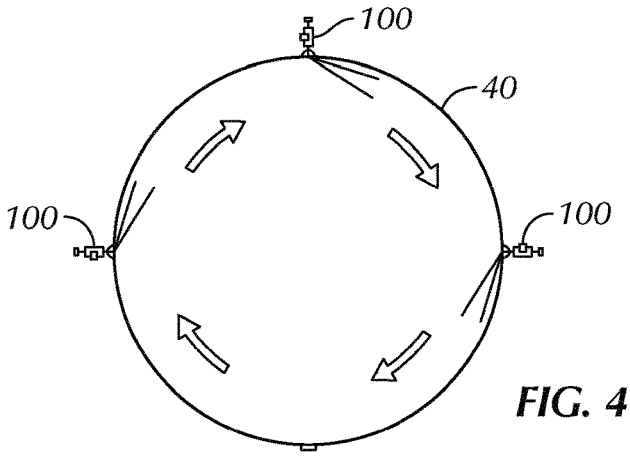
FIG. 4 shows an above view of a storage tank having multiple jetting tool systems installed thereon in accordance with one or more embodiments of the present disclosure.

Once the jetting tool system 100 has been properly secured within the manhole adaptor 60, the jetting tool system 100 may be used to circulate and separate sludge that has accumulated within the storage tank 40. One or more jetting tool systems 100 may be installed with the storage tank 40, as desired, such as depending on the size and shape of the storage tank, and/or the desired fluid circulation patterns within the storage tank 40. For example, with reference to FIG. 4, the storage tank 40 includes three jetting tool systems 100 installed thereon, in which the jetting tool systems 100 may introduce fluid pressure to induce a clockwise fluid circulation pattern within the storage tank 40. Those skilled in the art will appreciate that while three jetting tool systems are shown in this example, any number of jetting tool systems may be used in accordance with one or more embodiments disclosed herein.

Though details of the jetting tool system 100 are discussed further below, the jetting tool of the jetting tool system 100 may be movably disposed within the storage tank 40. For example, the jetting tool of the jetting tool system 100 may be able to rotate within the tank 40, such as being able to rotate vertically and/or horizontally within the tank 40. In one embodiment, the jetting tool may be able to rotate by at least about 40 degrees vertically with respect to the tank 40 and rotate by at least about 180 degrees horizontally with respect to the tank 40. As such, one having ordinary skill in the art will appreciate that a jetting tool system in accordance with the present disclosure may be able to induce multiple fluid circulation patterns within a storage tank.

Figures 5A, 5B:
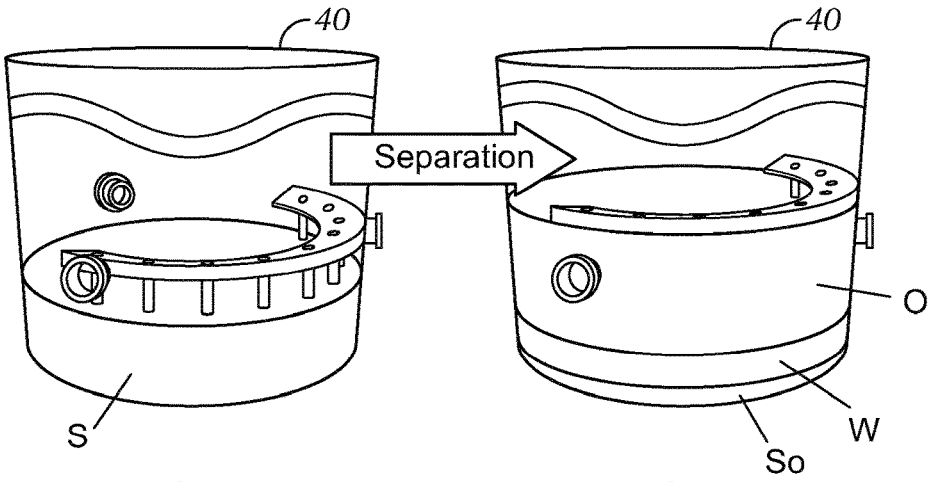
FIG. 5A shows an interior view of a storage tank before separation in accordance with one or more embodiments of the present disclosure.
FIG. 5B shows an interior view of a storage tank after separation in accordance with one or more embodiments of the present disclosure.

While the one or more jetting tool systems 100 provide fluid pressure to induce a circulation pattern within the tank 40, the jetting tool systems 100 may also introduce and disperse biosurfactants within the accumulated sludge of the storage tank 40. For example, biosurfactants based on rhamnolipids RLL (α-L-rhamnopyranosyl-α-L-rhamnopyranosyl-β-hydroxydecano-il-β-hydroxydecanoate) and/or rhamnolipids RRLL (2-O-α-L-rhamnopyranosyl-α-L-rhamnopyranosyl-β-hydroxydecanoil-β-hydroxydecanoate) may be dispersed and circulated within the storage tank 40. After introducing the biosurfactants into the storage tank 40 and circulating the contents within the storage tank 40, the jetting tool systems 100 may then stop introducing fluid pressure into the tank 40 such that the contents within the tank 40 may settle therein. Particularly, during this settling step, the biosurfactants enable the sludge emulsion within the tank to separate into oil and water, with the solids from the sludge settling to the bottom of the tank 40. For example, with reference to FIGS. 5A and 5B, the tank 40 may have sludge S, comprising of sand and gravel mixed with oil and water, accumulated at the bottom thereof. Biosurfactants may then be introduced into the tank 40 and the contents circulated within the tank 40, thereby causing the sludge S to separate and settle out into an oil layer O, a water layer W, and a solids layer So. In accordance with one or more embodiments of the present disclosure, the sludge may have up to 95% of the hydrocarbons removed and returned to the oil phase.

After circulation and separation of the sludge S within the tank 40, the contents of the tank 40 may then be pumped out to one or more desired locations. For example, the oil layer O may be pumped out of the tank 40, such as through the valve 64 (shown in FIG. 1B) of the manhole adaptor 60, to a desired location, in which the quality of the oil may be monitored by a mobile lab. Further, the water layer W may be pumped out of the tank 40 and back to a waste water tank and/or another desired location, in which the quality of the water may also be monitored by the mobile lab. Furthermore, it should be noted that the biosurfactants may not have any substantial detrimental effect on the oil quality and/or the environment.

Once the oil and water phases have been pumped out of the tank 40, the tank 40 may be put back into use and service, if desired. However, if the tank 40 is being cleaned for maintenance and/or inspection, then the tank 40 may be further cleaned to remove the solids layer So present within the tank 40. In accordance with one or more embodiments of the present disclosure, the jetting tool system 100 with the jetting tool 110 may include two or more nozzles to expel fluid into the tank 40, in which a first nozzle may be used to originally circulate and introduce biosurfactants into the contents of the tank 40, and a second nozzle may be used for the additional cleaning stages and removal of the solid layer So within the tank 40. As such, when cleaning the tank 40 to remove the solid layer So, the jetting tool system 100 may use the second nozzle to pump warm or hot water into the tank 40 for washing. The first nozzle and the second nozzle may be different from each other, such as by having the first nozzle larger or smaller in size than the second nozzle. The design and configuration of the dual nozzles will be discussed in more detail below.

Figure 6:
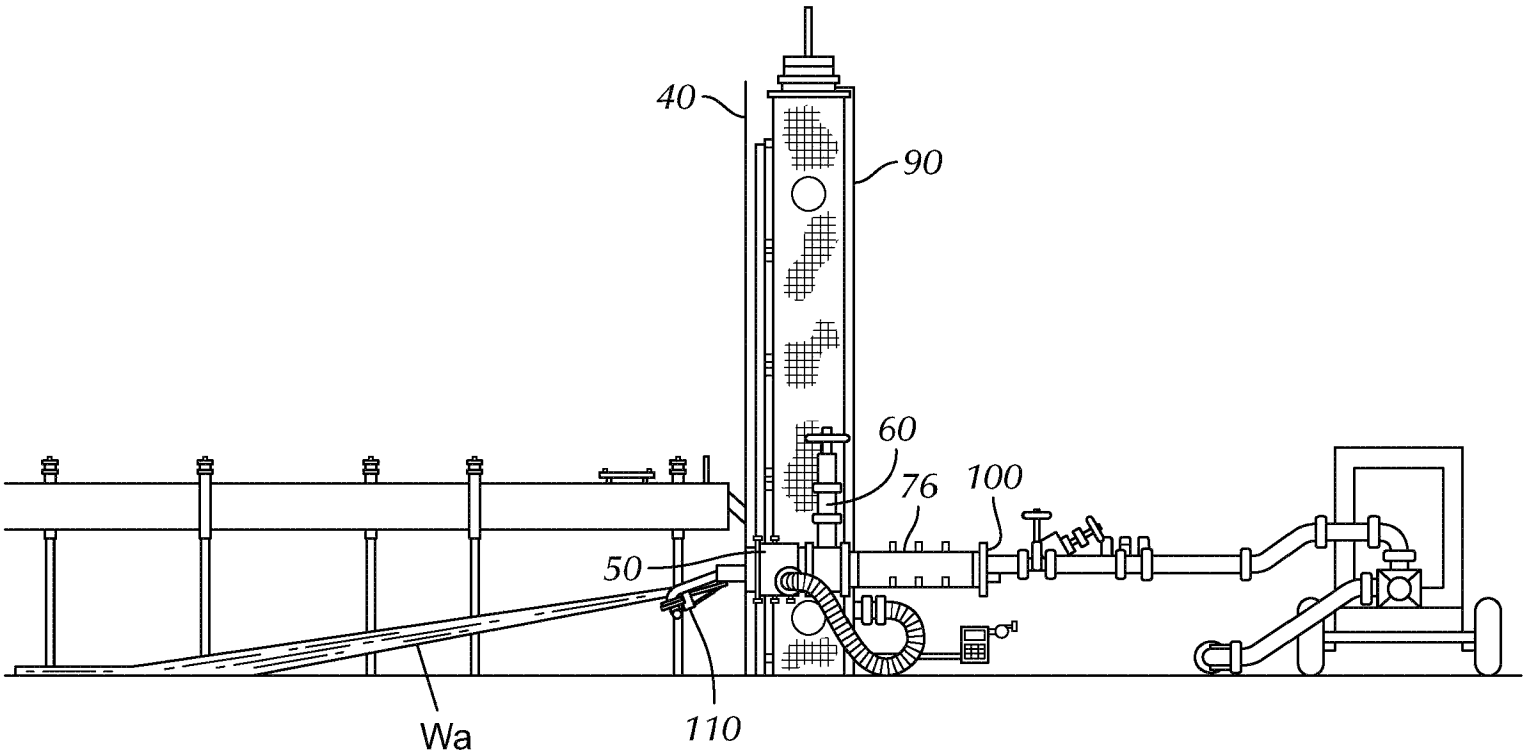
FIG. 6 shows a cutaway view of a storage tank having a jetting tool system installed thereon in accordance with one or more embodiments of the present disclosure.

For example, with reference to FIG. 6, washing water Wa may be pumped through the jetting tool system 100 and through the second nozzle of the jetting tool 110 into the tank 40 to wash the tank 40. The washing water Wa, mixed with the solids So and any other contents remaining in the tank 40, may then be pumped out of the tank 40, such as to an external separation system. By pumping the washing water Wa into the tank 40 through the jetting tool 110, this final washing step of the tank 40 may take place without having to open and/or enter the tank 40.

In addition to washing the tank 40 to remove the solid layer So, a degassing step may take place to extract any undesired gas from the tank 40. For example, in one embodiment, the NOGAS degassing method, commercially available from M-I, L.L.C., a Schlumberger Company, in Houston, Tex., may be used to degas the tank 40. In such an embodiment, a pneumatic extractor may be used to draw gas from the tank 40 into a gas-scrubbing column 90 (shown in FIG. 6) attached to the exterior of the tank 40. In the column 90, the gas may be neutralized with a nebulized spray of biotechnological and chemical products, such as LECS, also commercially available from M-I, L.L.C., and a gas monitoring system (not shown) may be installed at the top of the column 90 to monitor the quality of the gas released from the column 90.

Additionally, the degassing chemicals may be introduced into the tank 40 through the jetting tool system 100, such as by pumping the nebulized spray of the biotechnological and chemical products into the tank 40 through the second nozzle of the jetting tool 110. Further, the tank 40 may be provided with a LECS VOC CONTROL system, also commercially available from M-I, L.L.C., a system that sprays a fine mist of surfactants, chelating agents, and/or nutrients onto the gas within the tank to neutralize any volatile organic compounds (VOC). The degassing step may be used to reduce the Lower Explosive Limits (LEL) to below 5 percent within the tank 40.

Furthermore, if desired, personnel may then enter the tank 40 after the washing and degassing steps have taken place to perform a final cleaning step. The personnel may enter the tank 40 to remove any residual sludge and/or solids that may be collected within the tank 40, such as by operating equipment that collects the residual sludge and/or solids and pumps these contents out of the tank 40.

Figure 7A:
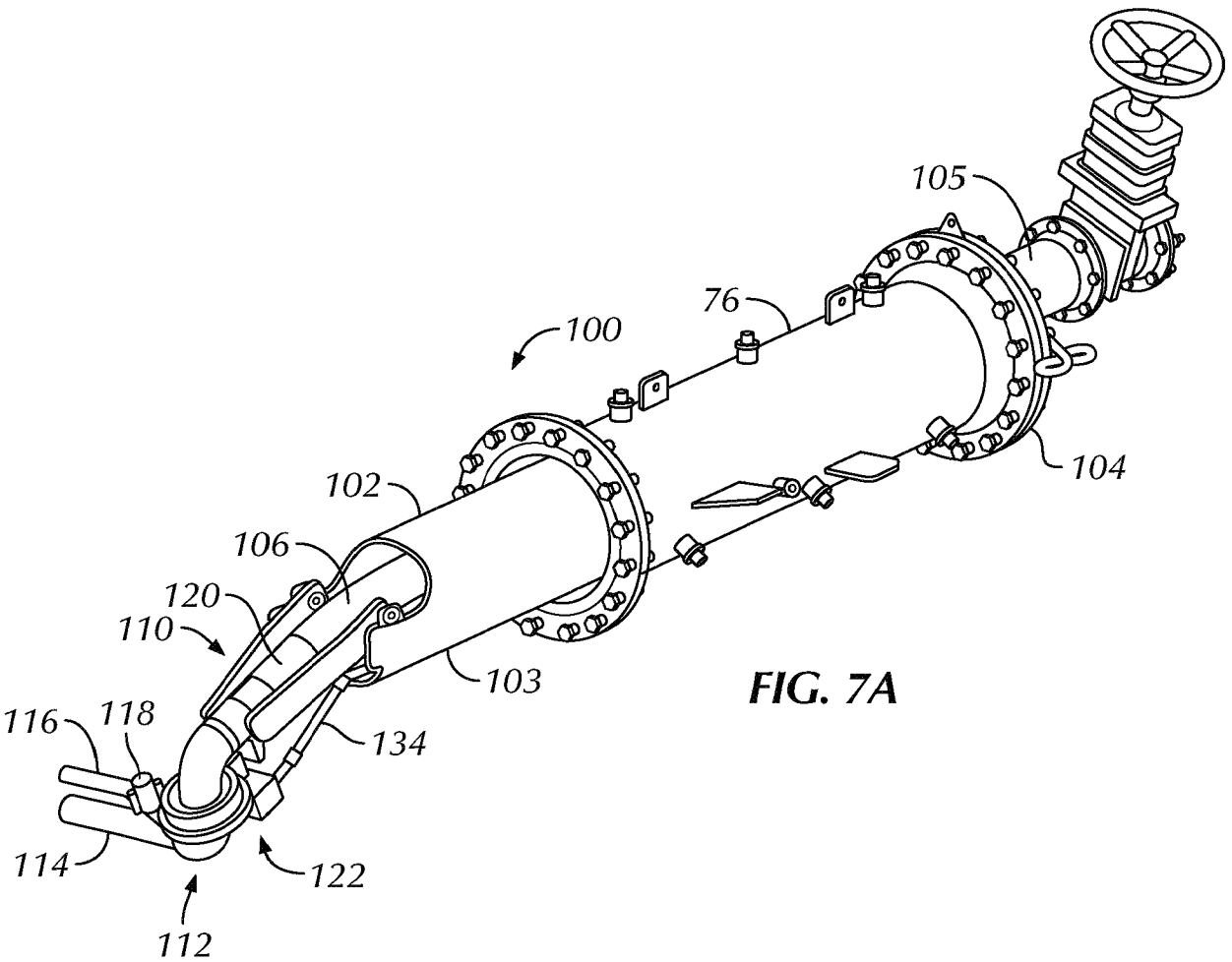
FIG. 7A shows a perspective view of a jetting tool system in accordance with one or more embodiments of the present disclosure.
Figure 7B:
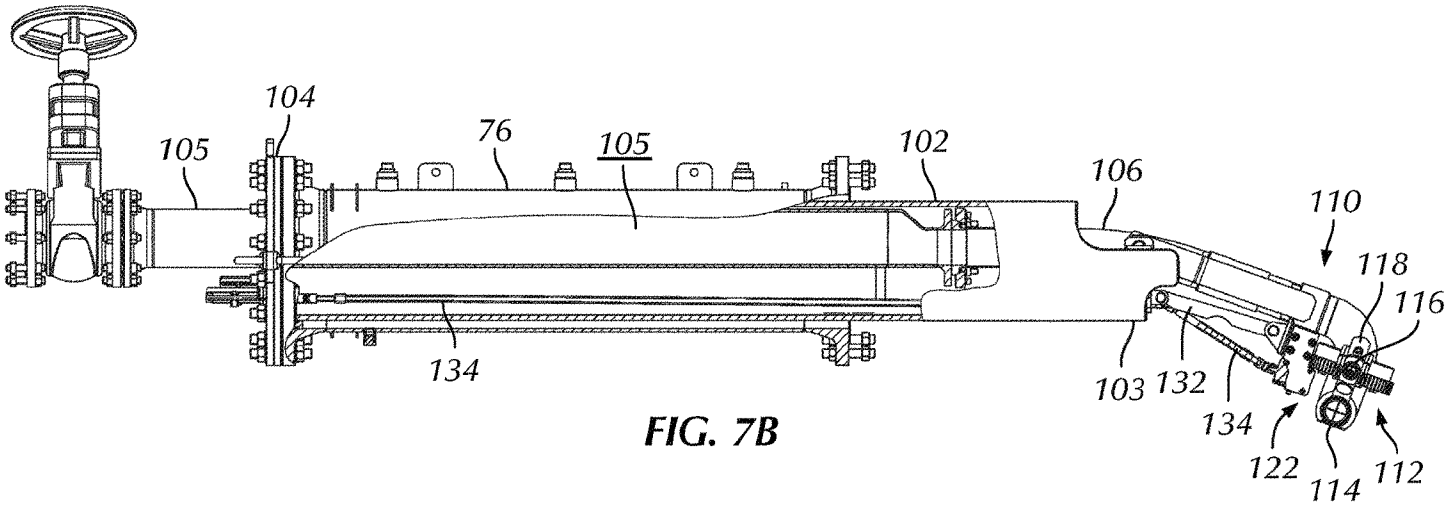
FIG. 7B shows a side cutaway view of a jetting tool system in accordance with one or more embodiments of the present disclosure.
Figure 7C:
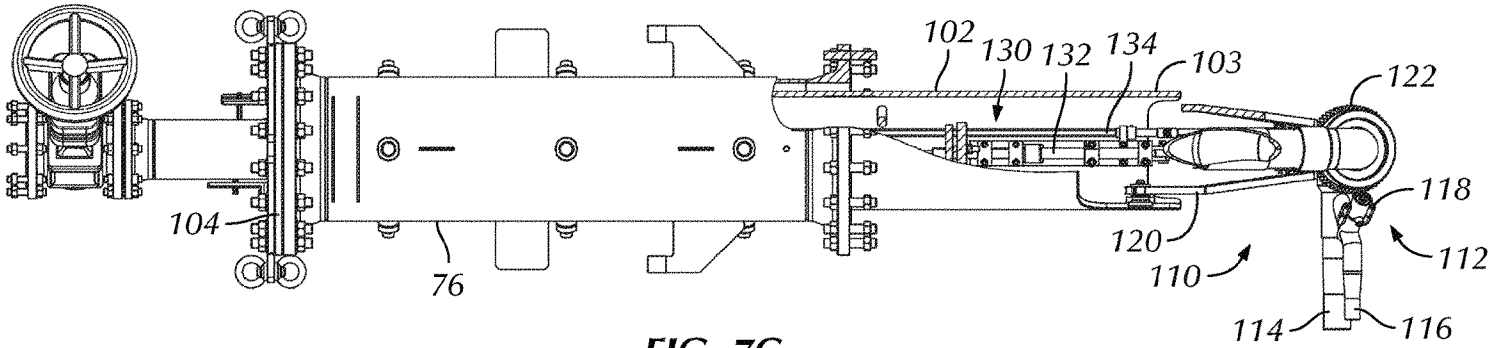
FIG. 7C shows an above cutaway view of a jetting tool system in accordance with one or more embodiments of the present disclosure.
Figure 7D:
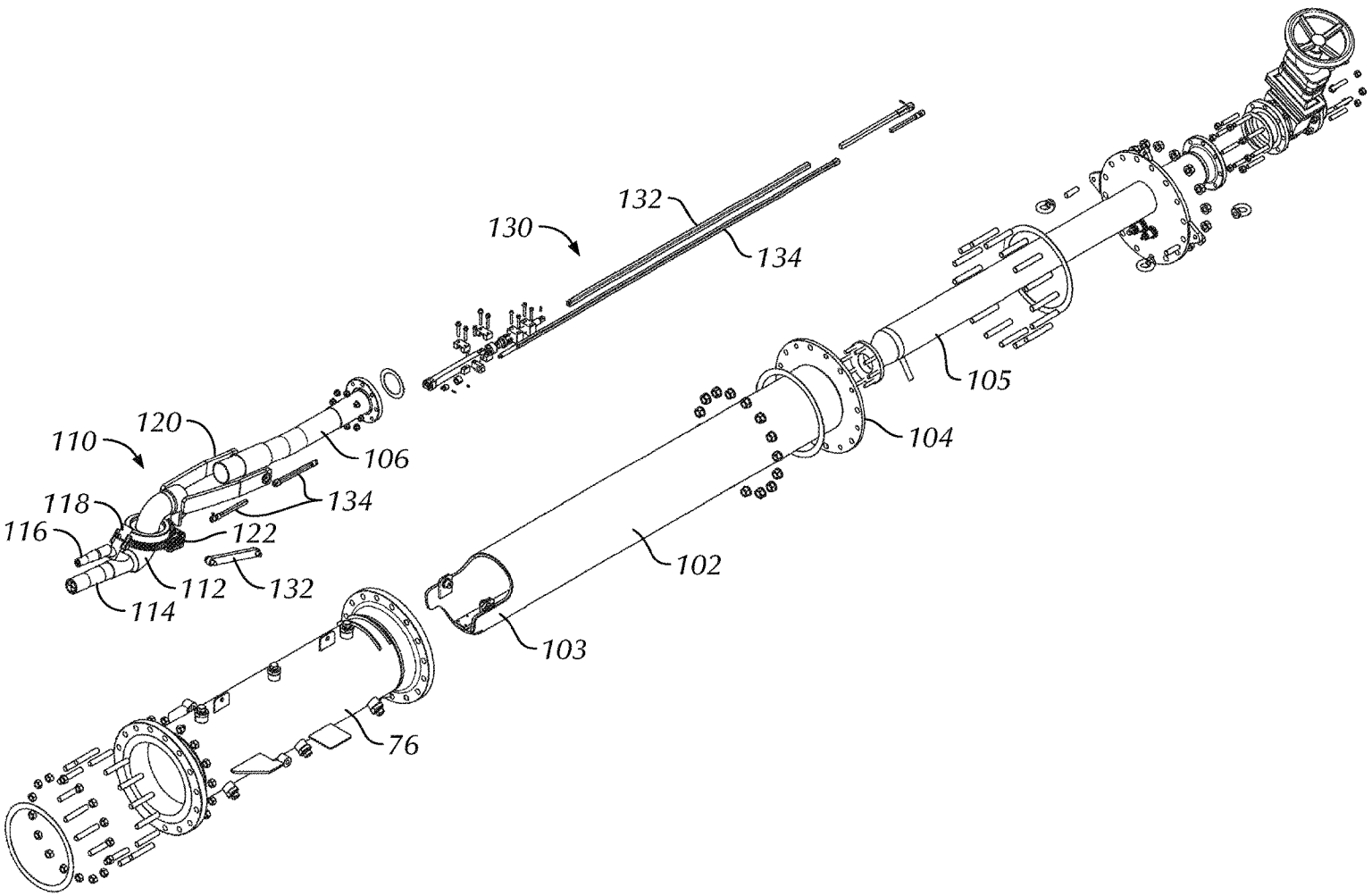
FIG. 7D shows an exploded view of a jetting tool system in accordance with one or more embodiments of the present disclosure.
Figure 7F:
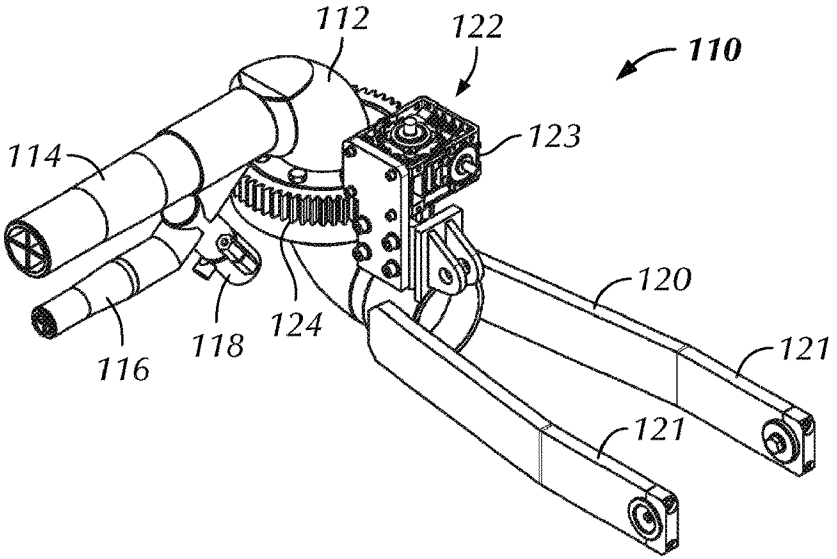
FIG. 7F shows a perspective view of a jetting tool in accordance with one or more embodiments of the present disclosure.
Figure 7E:
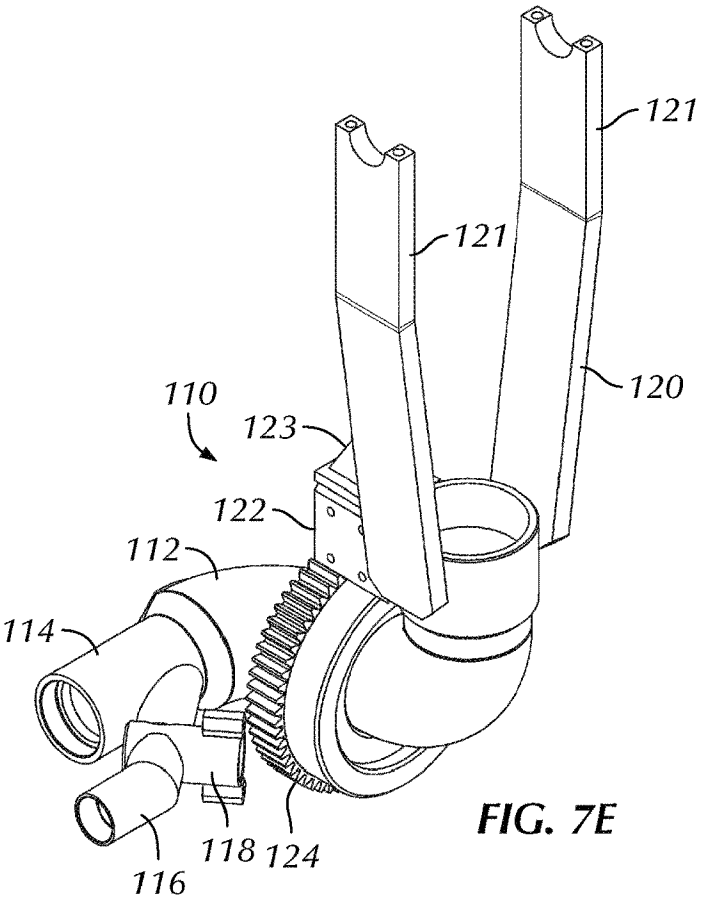
FIG. 7E shows a perspective view of a jetting tool in accordance with one or more embodiments of the present disclosure.
Figure 7G:
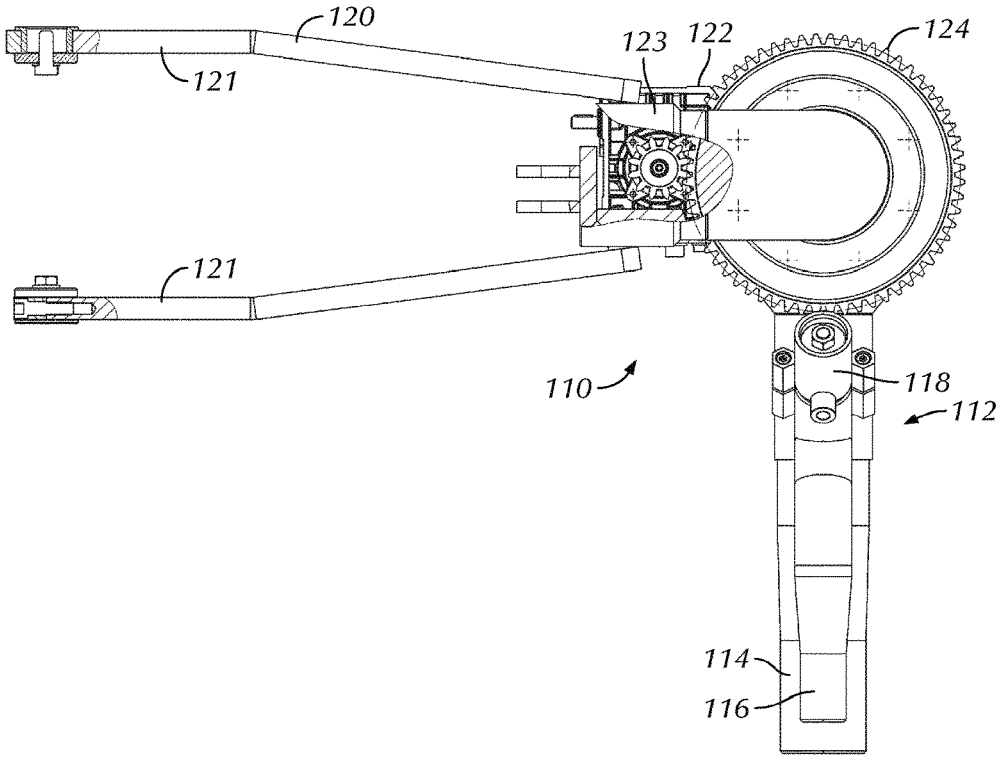
FIG. 7G shows an above cutaway view of a jetting tool in accordance with one or more embodiments of the present disclosure.

Referring now to FIGS. 7A-7G, multiple views of a jetting tool system 100 in accordance with one or more embodiments of the present disclosure are shown. Specifically, FIG. 7A provides a perspective view of the jetting tool system 100 disposed within the additional cylinder 76, FIG. 7B provides a side cutaway view of the jetting tool system 100 within the additional cylinder 76, FIG. 7C provides an above cutaway view of the jetting tool system 100 within the additional cylinder 76, and FIG. 7D provides an exploded view of the jetting tool system 100 with the additional cylinder 76. Further, FIGS. 7E and 7F provide perspective views of the jetting tool 100 of the jetting tool system 100, and FIG. 7G provides a cutaway above view of the jetting tool 100 of the jetting tool system 100.

As shown within FIGS. 7A-7D specifically, the jetting tool system 100 may include a housing 102, such as a cylindrical housing, having a first end 103 and a second end 104. The housing 102 includes a flowline 105 extending therethrough, in which the flowline 105 may be used to provide pressurized fluid to the jetting tool 110 disposed at the first end 103 of the housing 102. In addition to the flowline 105, a flexible hose 106 may be disposed adjacent to the first end 103 of the housing 102 and may be coupled between the flowline 105 and the jetting tool 110. The jetting tool 110 is movably attached to the first end 103 of the housing 102. As such, the flexible hose 106 may be used to enable fluid flow through the flowline 105 and through the flexible hose 106 to the jetting tool 110, even as the jetting tool 110 may be moving within the tank 40.

With reference to FIGS. 7A-7G, the jetting tool 110 may include a head 112 having a first nozzle 114 and a second nozzle 116. The first nozzle 114 and the second nozzle 116 may be different sizes from each other, such as for use for different applications, in which the first nozzle 114 may be larger than the second nozzle 116. Particularly, the orifice size of the first nozzle 114 may be larger than the orifice size of the second nozzle 116.

Fluid received from the flowline 105 may be expelled through the first nozzle 114 and/or the second nozzle 116 of the head 112 of the jetting tool 110 and into a storage tank. For example, as discussed above, pressurized fluid to circulate the contents within a storage tank and/or introduce biosurfactants into a storage tank may be expelled through the first nozzle 114 of the jetting tool 110, and washing water to wash away solids within a storage tank and/or introduce degassing chemicals into a storage tank may be expelled through the second nozzle 116 of the jetting tool 110.

In one or more embodiments, multiple methods and/or configurations may be used to move between expelling fluid from the first nozzle and expelling fluid from the second nozzle. For example, in one embodiment to move between the first nozzle 114 and the second nozzle 116 of the jetting tool 110, the head 112 of the jetting tool 110 may enable the first nozzle 114 and the second nozzle 116 to alternate and be rotated into and out of alignment, as desired, with a fluid supply line (i.e., flowline 105) extending through the jetting tool 110. In such an embodiment, the first nozzle 114 and the second nozzle 116 may be rotatable and/or otherwise movable between each other such that one of the first nozzle 114 and the second nozzle 116 is moved into a "enabled" position, while the other of the first nozzle 114 and the second nozzle 116 is moved into a "disabled" position. In another embodiment, the head 112 of the jetting tool 110 may include one or more valves therein to selectively direct fluid between the first nozzle 114 and the second nozzle 116.

For example, as shown specifically in FIGS. 7E-7G, the second nozzle 116 may include a valve 118, such as a hydraulic valve, that may be selectively opened and closed to direct fluid through the second nozzle 116. As such, multiple valves may be included within a jetting tool of the present disclosure to selectively direct fluid therethrough. Further, the control of the fluid flow through the jetting tool may be manually operated and/or may be automated, such as by having controllers and/or actuators controlling the movement of the first nozzle and the second nozzle. Those having ordinary skill in the art, however, will appreciate that other mechanisms, components, and arrangements may be used to move between expelling fluid from the first nozzle and expelling fluid from the second nozzle without departing from the scope of the present disclosure.

As mentioned above, the jetting tool 110 may be movably attached to the first end 103 of the housing 102. As such, the jetting tool 110 may be movably attached to the housing 102 such that the head 112 of the jetting tool 110, including the first nozzle 114 and the second nozzle 116, may be able to rotate both vertically and horizontally with respect to the housing 102. More specifically, the head 112 of the jetting tool 110 may be able to rotate along a first plane extending vertically through the housing 102, and also may be able to rotate along a second plane perpendicular to the first plane and extending horizontally with respect to the housing 102. By enabling the head 112 of the jetting tool 110 to have multiple degrees of freedom in both the vertical and horizontal directions within a storage tank, the jetting tool 110 may be able to induce multiple fluid circulation patterns within the storage tank. Accordingly, in one embodiment, the head 112, and therefore the first nozzle 114 and the second nozzle 116, may be able to rotate by at least about 40 degrees vertically with respect to the housing 102 and the storage tank, and may be able to rotate by at least about 180 degrees horizontally with respect to the housing 102 and the storage tank.

Referring now specifically to FIGS. 7E-7G, the jetting tool 110 may further include a support structure 120 and/or a gear assembly 122. The support structure 120, shown in this embodiment as a fork assembly having a pair of arms 121, may be movably attached to the first end 103 of the housing 102, thereby enabling the head 112 of the jetting tool 110 to rotate vertically with respect to the housing 102 and a storage tank. Further, the gear assembly 122, shown in this embodiment as a gear box 123 engaging a gear 124 attached to the head 112, may be coupled between the head 112 of the jetting tool 110 and the support structure 120 of the jetting tool 110. The gear assembly 122 may enable the head 112 of the jetting tool 110 to rotate horizontally with respect to the housing 102 and a storage tank. As such, different components of the jetting tool 110 may be used to control different directions of movement of the jetting tool 110. Those having ordinary skill in the art, however, will appreciate that other mechanisms, components, and arrangements may be used to enable movement of a jetting tool without departing from the scope of the present disclosure.

Further, to enable movement of the jetting tool 110 within a storage tank, the jetting tool system 100 may include an actuator assembly 130 coupled to the jetting tool 110 that may be used to control the movement of the jetting tool 110 with respect to the housing 102. For example, as particularly shown in FIG. 7D, the actuator assembly 130 may be disposed within the housing 102 and extend between the first end 103 and the second end 104 of the housing 102. As such, the actuator assembly 130 may be used to control the vertical rotation and/or the horizontal rotation of the jetting tool 110 within a storage tank, as discussed above. Further, the actuator assembly 130 may be manually operated, such as by having personnel manually control the movement of the jetting tool 110 using the actuator assembly 130, and/or the actuator assembly 130 may be automated, such as by having controllers and/or actuators controlling the movement of the jetting tool 110 using the actuator assembly 130.

In this embodiment, the actuator assembly 130 may include a first link assembly 132 and a second link assembly 134. The first link assembly 132 and the second link assembly 134 each include one or more links, such as one or more rods, stems, and/or pipes connected and/or coupled to each other, and extend between the first end 103 and the second end 104 of the housing 102. The first link assembly 132 may be used to control vertical rotation of the head 112 of the jetting tool 110, such as by having the first link assembly 132 coupled to the support structure 120 of the jetting tool 110. Further, the second link assembly 134 may be used to control horizontal rotation of the head 112 of the jetting tool 110, such as by having the second link assembly 134 coupled to the gear box 122 of the jetting tool 110. The ends of the first link assembly 132 and the second link assembly 134 may also be accessible at the second end 104 of the housing 102 to enable convenient access to and control over the actuator assembly 130. Those having ordinary skill in the art, however, will appreciate that other mechanisms, components, and arrangements, such as one or more hydraulic or pneumatic actuators (e.g., piston and rod assembly) and/or one or more electric actuators (e.g., a motor), may be used to enable movement of a jetting tool without departing from the scope of the present disclosure. For example, in one embodiment, one or more motors may be attached and/or coupled to the head of the jetting tool, in which a control unit may be used to control the one or motors to rotate the head in the vertical direction and/or the horizontal direction, as desired.

In one or more embodiments, a jetting tool system in accordance with the present disclosure may include and/or be used in conjunction with a data processing unit, a control unit, and/or one or more sensors configured to detect the state of the components used with a storage tank. For example, a sensor may be coupled to the jetting tool system to determine the position and the orientation of the jetting tool within the storage tank. Further, the data processing unit may be able to process data related to the state of the contents within the storage tank, such as determine an optimal or desired circulation pattern within the storage tank, and then the control unit may be used to control the movement of the jetting tool accordingly. As such, sensors, control units, data processing units, and/or any other electrical components may be used within the present disclosure for control or automization of the jetting tool system.

In one aspect, embodiments disclosed herein relate to a system to clean a tank that stores oil products. The system includes a housing having a first end and a second end, a flowline disposed within the housing and extending through the housing, and a jetting tool having a first nozzle and a second nozzle. The jetting tool is movably attached to the first end of the housing, and the jetting tool is configured to receive fluid from the flowline and expel the fluid through at least one of the first nozzle and the second nozzle of the jetting tool.

In another aspect, embodiments disclosed herein relate to a jetting tool configured to clean a tank that stores oil products. The jetting tool includes a head having a first nozzle and a second nozzle, a support structure configured to movably attach to an end of a housing extending into the tank such that the head rotates vertically with respect to the housing, and a gear assembly coupled between the head and the support structure such that the head of the jetting tool is configured to rotate horizontally with respect to the housing.

In another aspect, embodiments disclosed herein relate to a method to install a jetting tool within a tank that stores oil products. The method includes attaching the jetting tool having a head with a first nozzle and a second nozzle to a first end of a housing, fluidly coupling the jetting tool to a flowline extending through the housing such that fluid received within the flowline is configured to be expelled through at least one of the first nozzle and the second nozzle of the jetting tool, and inserting the first end of the housing with the jetting tool attached thereto into the tank such that the first nozzle and the second nozzle of the jetting tool is disposed within the tank.

In another aspect, embodiments disclosed herein relate to a method to clean a tank that stores oil products. The method includes inserting a jetting tool having a head with a first nozzle and a second nozzle within the tank, providing a first fluid to the jetting tool, expelling the first fluid into the tank through the first nozzle of the jetting tool, providing a second fluid to the jetting tool, and expelling the second fluid into the tank through the second nozzle of the jetting tool.

Other aspects and advantages exempwill be apparent from the following description and the appended claims.

Advantageously, embodiments of the present disclosure may provide a jetting tool and/or a jetting tool system that may be able to reduce the amount of time for cleaning a tank storing oil products. For example, the time to change the nozzles for one jetting tool may take up to 45 minutes or more, and most tanks have at least two jetting tools installed therewith. However, a jetting tool in accordance with the present disclosure may demand a matter of minutes to switch between nozzles, as the jetting tool is provided with multiple nozzles with the switching between the nozzles possibly even being automated. Further, embodiments of the present disclosure may provide a jetting tool and/or a jetting tool system that may be able to reduce the health and safety risks to the cleaning personnel. For example, personnel may no longer have to enter storage tanks at all, or will enter storage tanks during the final steps of the cleaning process, thereby limiting the cleaning personnel exposure to any volatile organic compounds, harmful gases, and/or other hazards common to the environment within a storage tank.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited by the attached claims.

What is claimed is:

1. A jetting tool configured to clean a tank that stores oil products, the jetting tool comprising:

a head having a first nozzle and a second nozzle;

a housing having a length defined between a first end and an opposite second end, wherein the housing is configured to be extendible into the tank;

a support structure connected to the head and the first end of the housing such that the head is vertically rotatable with respect to the housing via the support structure;

a gear assembly coupled between the head and the support structure, wherein the support structure provides a spacing between the gear assembly and the first end of the housing such that the gear assembly is located outside the housing and the head is horizontally rotatable with respect to the housing via a gear of the gear assembly that is rotatable in a first direction; and a fluid supply line extending within the housing and connected to first nozzle and second nozzle to expel fluid through the first nozzle or second nozzle, wherein the first nozzle or the second nozzle is configured to expel fluid in a second direction that is different than the first direction, wherein at least one of the first nozzle and the second nozzle comprises a hydraulic valve coupled thereto and configured to control fluid flow from the fluid supply line to the first nozzle and the second nozzle.

2. The jetting tool of claim 1, wherein the first nozzle of the jetting tool is larger than the second nozzle of the jetting tool.

3. The jetting tool of claim 1, wherein the support structure comprises at least one arm configured to rotatably attach to the first end of the housing extending into the tank.

4. The jetting tool of claim 1, wherein the head is configured to rotate by at least about 40 degrees vertically with respect to the housing and is configured to rotate by at least about 180 degrees horizontally with respect to the housing.

5. The jetting tool of claim 1, wherein the first nozzle and the second nozzle of the head are configured to alternate between an enabled position configured to expel the fluid therefrom and a disabled positioned configured to inhibit fluid flow therethrough.

6. The jetting tool of claim 1 wherein the first nozzle and the second nozzle are rotatable into and out of alignment with the fluid supply line such that one of the first nozzle and second nozzle is moved into an enabled position while the other of the first nozzle and the second nozzle is moved into a disabled position, and further wherein, at the enabled position, fluid is expelled out of only one of the first nozzle or second nozzle, respectively, and, at the disabled position, fluid is not expelled out of only one at least one of the first nozzle or the second nozzle.

7. The jetting tool of claim 1 wherein the housing of the jetting tool is securable to a manhole adaptor, and further wherein the jetting tool is insertable within the manhole adaptor.

8. The jetting tool of claim 1 further comprising:

an actuator assembly within the housing extending between a first end of the housing and a second end of the housing, wherein the actuator assembly is configured to control movement of the jetting tool with respect to the housing.

9. The jetting tool of claim 8, further comprising:

a first link assembly within the housing to control vertical rotation of the jetting tool with respect to the housing; and a second link assembly within the housing to control horizontal rotation of the jetting tool with respect to the housing.

10. The jetting tool of claim 1 further comprising:

a flexible hose coupled between the jetting tool and the fluid supply line such that fluid from the fluid supply line flows through the flexible hose to the jetting tool.

11. A system comprising:

a flowline disposed within the housing and extending through the housing; and the jetting tool according to claim 1, the jetting tool movably attached to the first end of the housing, wherein the jetting tool is configured to receive fluid from the flowline and expel the fluid through at least one of the first nozzle and the second nozzle of the jetting tool.

12. The system of claim 11, wherein the jetting tool is movably attached to the first end of the housing such that the first nozzle and the second nozzle of the jetting tool are configured to rotate along a first plane with respect to the housing and rotate along a second plane perpendicular to the first plane with respect to the housing.

13. A method comprising:

attaching the jetting tool according to claim 1 to the first end of the housing;

fluidly coupling the jetting tool to a flowline extending through the housing such that fluid received within the flowline is configured to be expelled through at least one of the first nozzle and the second nozzle of the jetting tool; and inserting the first end of the housing with the jetting tool attached thereto into the tank such that the first nozzle and the second nozzle of the jetting tool are disposed within the tank.

14. The method of claim 13, wherein attaching the jetting tool comprises attaching the jetting tool to the first end of the housing such that the head of the jetting tool is configured to rotate both vertically and horizontally with respect to the housing within the tank.

15. The method of claim 13, wherein attaching the jetting tool comprises:

movably attaching the support structure of the jetting tool to the first end of the housing such that the head of the jetting tool is configured to rotate vertically with respect to the housing; and coupling a gear assembly between the head of the jetting tool and the support structure of the jetting tool such that the head of the jetting tool is configured to rotate horizontally with respect to the housing.

16. The method of claim 13, further comprising:

disposing an actuator assembly within the housing extending between the first end of the housing and the second end of the housing; and coupling the actuator assembly to the jetting tool such that the actuator assembly is configured to control movement of the jetting tool with respect to the housing.

17. The method of claim 16, wherein the disposing the actuator assembly within the housing comprises:

disposing a first link assembly within the housing to control vertical rotation of the head of the jetting tool with respect to the housing; and disposing a second link assembly within the housing to control horizontal rotation of the head of the jetting tool with respect to the housing.

18. The method of claim 13, further comprising:

moving the first nozzle of the head from an enabled position to a disabled position such that the first nozzle is configured to inhibit fluid flow therethrough; and moving the second nozzle of the head from the disabled position to the enabled position such that the second nozzle is configured to expel fluid therefrom.

19. The method of claim 13, further comprising:

providing a first fluid to the jetting tool; expelling the first fluid into the tank through the first nozzle of the jetting tool;

providing a second fluid to the jetting tool; and expelling the second fluid into the tank through the second nozzle of the jetting tool.

20. The method of claim 19, further comprising:

rotating the head of the jetting tool vertically and horizontally with respect to the tank.

* * * * *